US007976080B1

(12) United States Patent
Duff

(10) Patent No.: US 7,976,080 B1
(45) Date of Patent: Jul. 12, 2011

(54) DOORSTOP WITH RELEASABLY SECURABLE HANDLE

(76) Inventor: Robert O. Duff, Farmington, MN (US)

( * ) Notice: Subject to any disclaimer, the term of this patent is extended or adjusted under 35 U.S.C. 154(b) by 114 days.

(21) Appl. No.: 12/080,920

(22) Filed: Apr. 7, 2008

Related U.S. Application Data

(60) Provisional application No. 60/962,743, filed on Jul. 31, 2007, provisional application No. 60/922,109, filed on Apr. 6, 2007.

(51) Int. Cl.
*E05C 5/04* (2006.01)
*E05C 17/54* (2006.01)

(52) U.S. Cl. ..... 292/343; 292/251.5

(58) Field of Classification Search ..... 292/343, 292/DIG. 15, 342, 338, 251.5; 16/82
See application file for complete search history.

(56) References Cited

U.S. PATENT DOCUMENTS

| | | | | |
|---|---|---|---|---|
| 1,119,650 | A | 12/1914 | Smith | |
| 1,939,402 | A | 12/1933 | Moser | |
| 3,124,382 | A | 3/1964 | Strother | |
| 3,143,369 | A | 8/1964 | Adams | |
| 4,607,253 | A | 8/1986 | Wooten et al. | |
| 4,883,297 | A * | 11/1989 | Smith | 292/339 |
| 5,217,269 | A | 6/1993 | Wiltberger | |
| 5,787,548 | A | 8/1998 | Tzen | |
| 6,085,766 | A | 7/2000 | Geary | |
| 6,557,915 | B1 * | 5/2003 | Duff | 292/343 |
| 6,581,776 | B2 * | 6/2003 | Zatkoff | 206/576 |

FOREIGN PATENT DOCUMENTS

GB 2279108 A 12/1994

* cited by examiner

*Primary Examiner* — Carlos Lugo
*Assistant Examiner* — Mark Williams
(74) *Attorney, Agent, or Firm* — Kinney & Lange, P.A.

(57) ABSTRACT

A doorstop has a foot coupled to a lower end of a handle. The handle of the doorstop has a length that allows a user to insert the foot under a lower edge of a door and to remove the foot from under the lower edge without requiring the user to bend over. The handle is removable from the foot for easy storage and travel. The doorstop foot may include a button for attachment to a clip thereby enabling a user to carry the doorstop on a belt. The coupling between the foot and handle is releasably securable and may be mechanical or magnetic. The handle may also telescope between a contracted position and an extended position.

8 Claims, 4 Drawing Sheets

DOORSTOP WITH RELEASABLY SECURABLE HANDLE

CROSS-REFERENCE TO RELATED APPLICATION(S)

This application claims priority from provisional application No. 60/962,743 filed Jul. 31, 2007, for "Doorstop with Removable Handle" and provisional application No. 60/922,109 filed Apr. 6, 2007, for "Doorstop with Magnetic Telescoping Handle", which are both incorporated by reference.

BACKGROUND

The present invention relates to a portable doorstop having a releasably securable handle and ergonomic advantages.

Doorstops are used in various professions and in everyday use for holding a door open. Most doorstops are placed under a lower edge of the door by an individual who must bend over to place the doorstop into position. The doorstop is then often kicked into position under the door to hold the door into place. Kicking the doorstop into place under the lower edge of the door causes damage to the door. However, not using a doorstop causes scratches and damage to the door by an object being forced through the doorway.

In certain professions such as maintenance, delivery and janitorial, propping a door open with the doorstop is done many times in one day. The repeated action of bending down to the floor to place the doorstop puts a stress on the individual's back. Thus, repeated use of a doorstop can lead to back injuries for the individual. Some persons, such as the elderly or handicapped are unable to bend down to place a doorstop to hold a door open and often lack other means for holding the door open.

There is a need for a doorstop that is portable and can be used by an individual multiple times a day, has ergonomic advantages preventing back injuries or bending down, does not damage the door and is easy to use.

SUMMARY

The present invention is a doorstop with a foot and a releasably securable handle. Preferably, the handle has a length that allows a user to insert the foot under a lower edge of a door and to remove the foot from under the lower edge of the door without requiring the user to bend over. The doorstop foot is substantially hollow and has a similar construction to the doorstop foot described in U.S. Pat. No. 6,557,915, the disclosure of which is hereby incorporated by reference for that purpose. The doorstop foot may include a button for attachment to a clip thereby enabling a user to carry the doorstop on a belt.

The handle has an upper end, a lower end, and a coupling mechanism. In one embodiment the coupling mechanism between foot and handle is magnetic. In another embodiment the coupling mechanism between foot and handle is mechanical. In both embodiments, the handle is releasably securable to the foot. The handle may include a hand grip on the top portion. The handle may also telescope between a contracted position and an extended position or the handle may have a fixed length. A single handle may be used with any number of doorstop feet. For example, a user may carry a number of doorstop feet to hold open a number of doors for cleaning work, maintenance work, moving work, or other tasks, and may utilize a single handle to manipulate those doorstop feet as desired.

In use, the foot of the doorstop may be positioned by a user on a floor to hold a door in place. This can be accomplished by manipulating the handle, which is secured to foot, so that the foot can be positioned underneath the lower edge of the door without requiring the user to bend over. Similarly, when the user would like to pick up a doorstop, the user can grasp the handle and pull the foot out from underneath the lower edge of the door without having to bend over and potentially strain the user's back.

DETAILED DESCRIPTION

Figure 1:
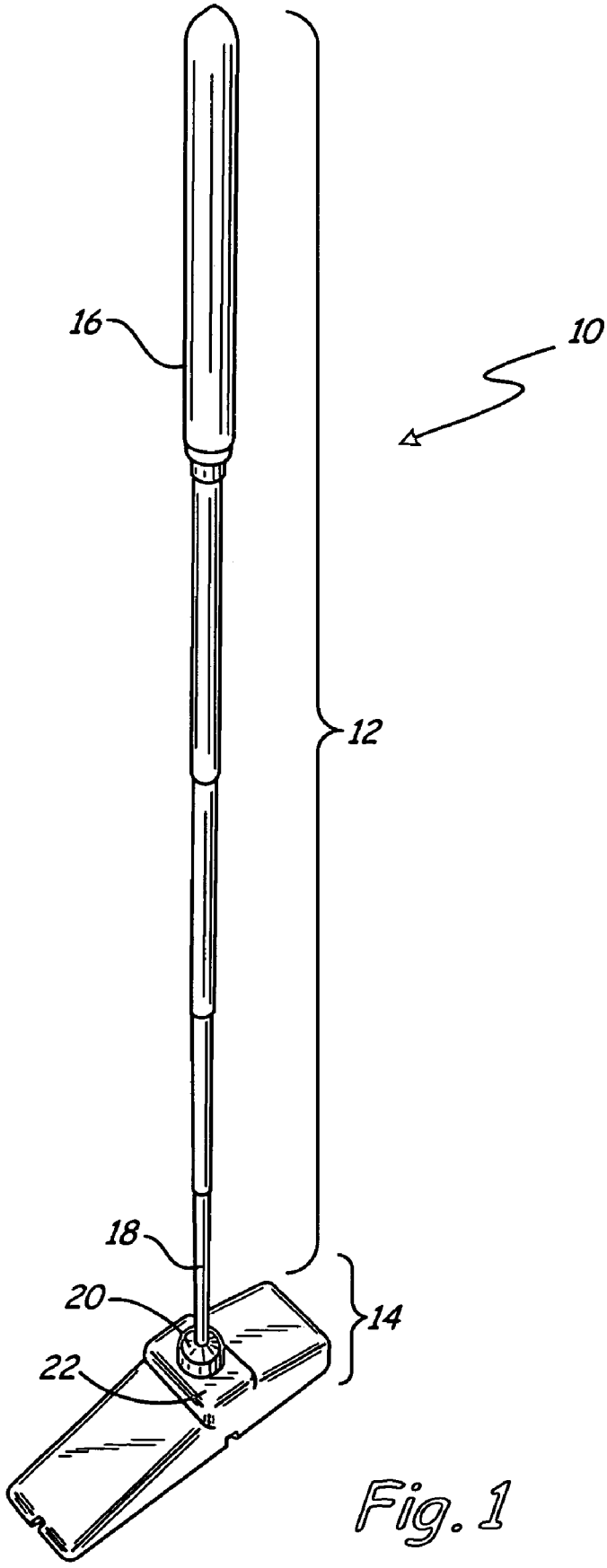
FIG. 1 is a side view of a doorstop with a telescoping handle in an extended position with magnetic coupling between handle and foot.

FIG. 1 depicts doorstop 10 with magnetic coupling between handle 12 and foot 14. Handle 12 includes upper end 16 and lower end 18. Upper end 16 may include a hand grip. Lower end 18 has first magnet 20 and foot 14 has second magnet 22, thereby magnetically coupling handle 12 to foot 14. Magnet 22 may be recessed in foot 14 such that a top surface of magnet 22 is flush or substantially coplanar with a top surface of foot 14. Foot 14 may be substantially hollow and constructed similar to the doorstop foot described in U.S. Pat. No. 6,557,915, the disclosure of which is hereby incorporated by reference for that purpose. Lower end 18 of handle 12 is capable of telescoping into upper end 16 of handle 12; however, FIG. 1 depicts handle 12 in a fully extended position.

Figure 2:
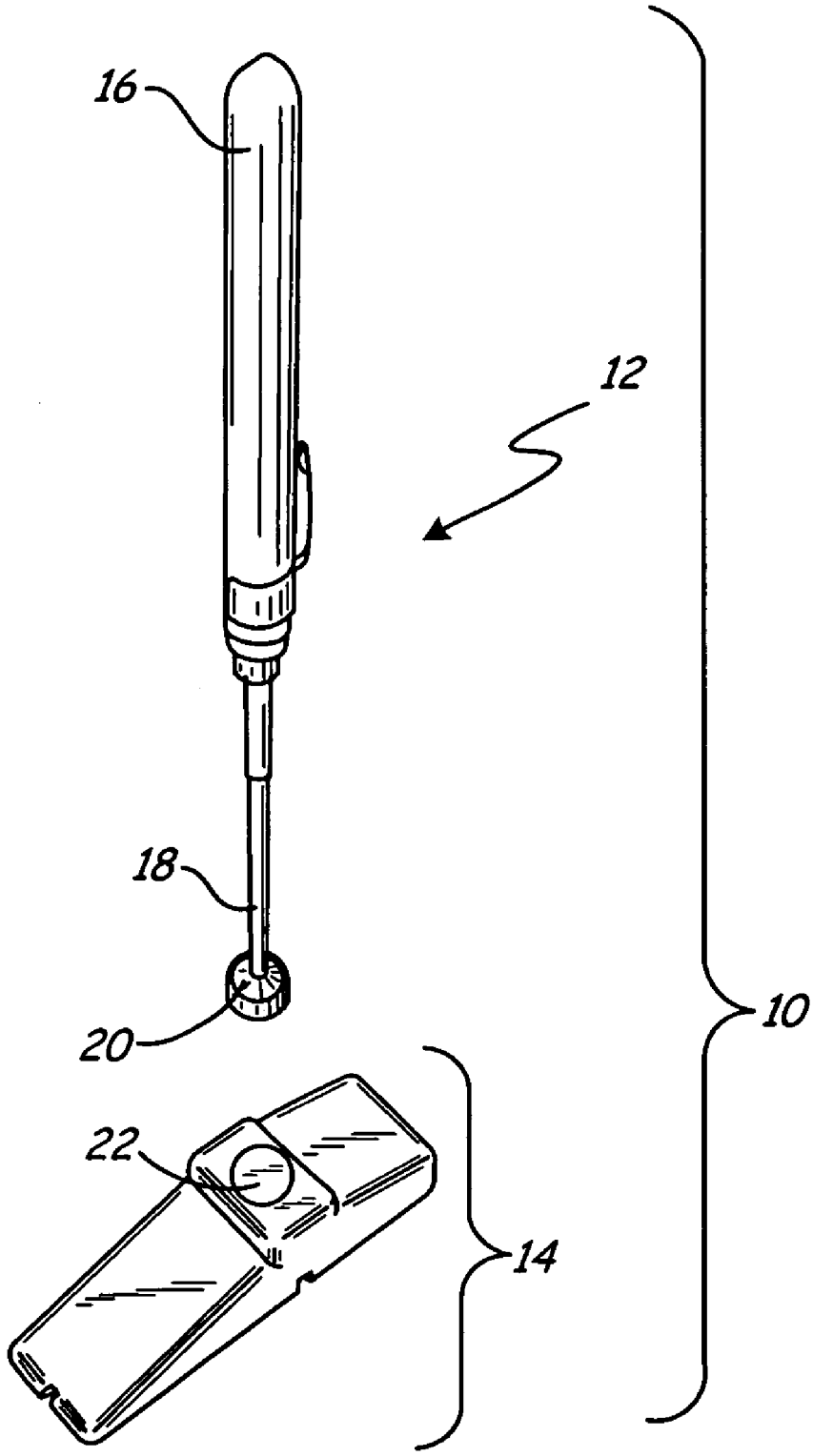
FIG. 2 is a side view of a doorstop with a telescoping handle in a collapsed position with magnetic coupling between handle and foot.

FIG. 2 depicts the same handle 12 of FIG. 1, but with handle 12 in a contracted position. Upper end 16 telescopically receives lower end 18 to make handle 12 compact. When handle 12 is in this contracted position and magnet 20 is decoupled from magnet 22 of foot 14, the entire doorstop 10 transports easily in two pieces: compact handle 12 and foot 14. In an exemplary embodiment, handle 12 has a total length of about 26 inches or longer in its fully extended position, but only a total length of about 6 inches in its fully contracted position.

In use, doorstop 10 may be positioned by a user on a floor under a lower edge of a door to hold the door in place. This can be accomplished by manipulating fully extended handle 12 with first magnet 20 magnetically coupled to second magnet 22 of foot 14, so that foot 14 can be positioned under the lower edge of a door without requiring the user to bend over. Similarly, when the user would like to pick up doorstop 10 handle 12 may be fully extended so that the user is able to easily magnetically attach first magnet 20 of handle 12 with second magnet 22 of foot 14, without having to bend over and potential strain the user's back. In an exemplary embodiment, magnet 20 is a 12-pound magnet, meaning that it is a magnet exhibiting sufficient attraction force to pick up 12 pounds. In order to detach handle 12 from foot 14, a user may pull on handle 12 or foot 14 with sufficient force to break the magnetic connection between first magnet 20 and second magnet 22.

A single handle 12 may be used with any number of doorstop feet 14. For example, a user may carry a number of doorstop feet 14 to hold open a number of doors for cleaning work, maintenance work, moving work, or other tasks, and may utilize a single handle 12 to manipulate those doorstops as desired.

Figure 3:
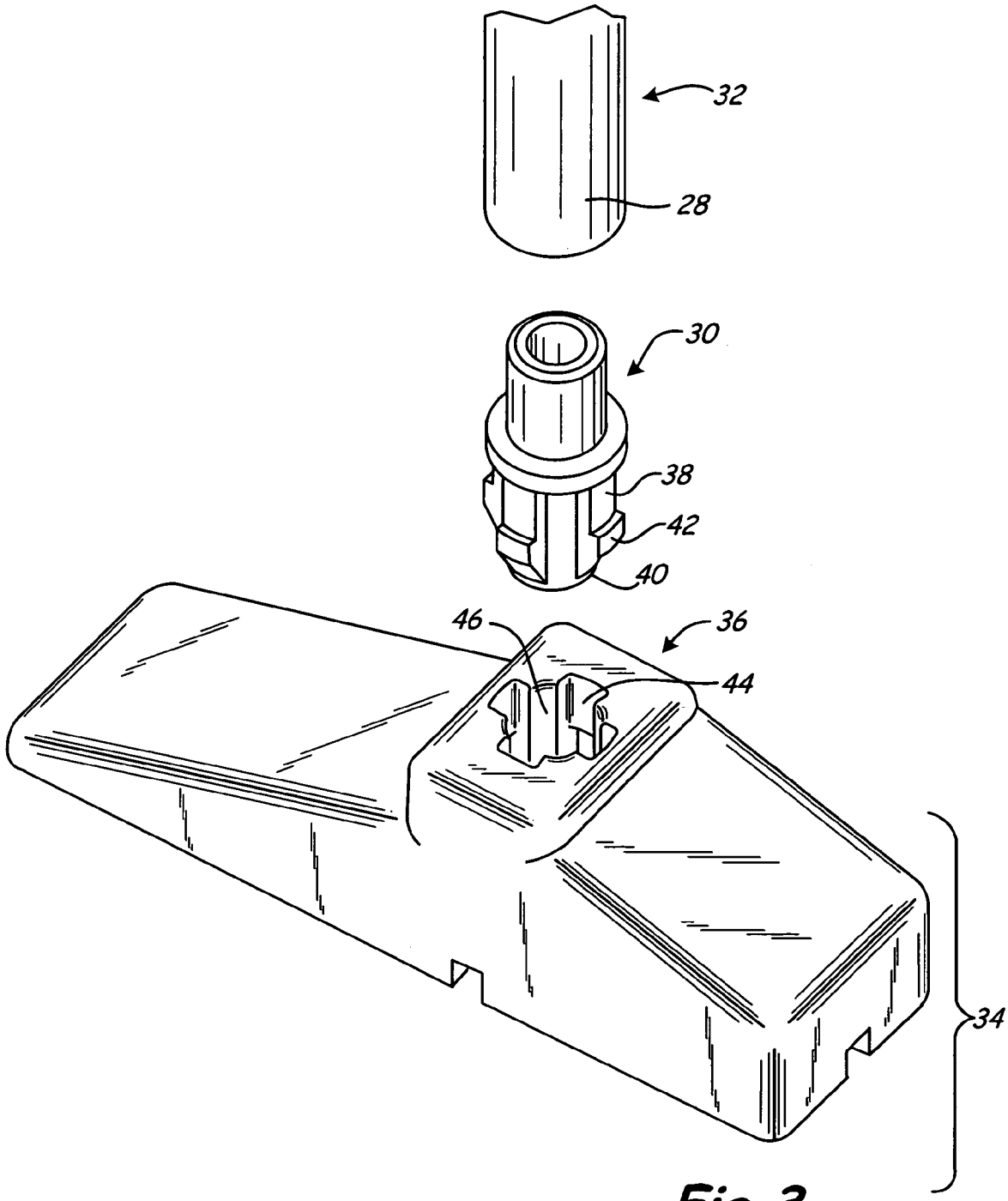
FIG. 3 is an exploded diagram of a doorstop with a handle and a foot that can be mechanically coupled together.

FIG. 3 depicts an exploded diagram of an alternative coupling mechanism. Instead of magnetically coupling handle 12 with foot 14, as seen in FIGS. 1 and 2, FIG. 3 depicts a structure that allows mechanical coupling and de-coupling between handle 32 and foot 34. Coupling 30 may be attached to or integrally formed with lower end 28 of handle 32. Handle 32 may have a fixed length or may telescope between an extended position and a compact position. Foot 34 includes a coupling opening 36 for receiving coupling 30 so that handle 32 can be releasably secured to foot 34.

Coupling 30 includes a plurality of tabs 38, each having angled portion 40 and ridge portion 42. Coupling opening 36 of foot 34 has grooves 44 and ridges 46. When coupling 30 is inserted into coupling opening 36, angled portions 40 slide across coupling opening 36 until ridge portions 42 find grooves 44. A user simply turns the coupling 30 until it is securely received in coupling opening 36 of foot 34, with ridge portions 42 received in grooves 44 and abutting ridges 46 of coupling opening 36. This mechanical mating system prevents the coupling 30 from sliding out of the coupling opening 36 without sufficient compression force. In order to remove coupling 30 (which is typically connected to lower end 28 of handle 32) from foot 34, a user may push down and rotate handle 32. This user generated compression force is transferred to the coupling 30 and will press ridge portion 42 in toward the axis of coupling 30 so that ridge portion 42 can be dislodged from groove 44 and past ridge 46 of coupling opening 36. In an exemplary design, coupling 30 is composed of a relatively flexible material such as plastic or rubber, so that a user can apply sufficient compression force manually.

Figure 4:
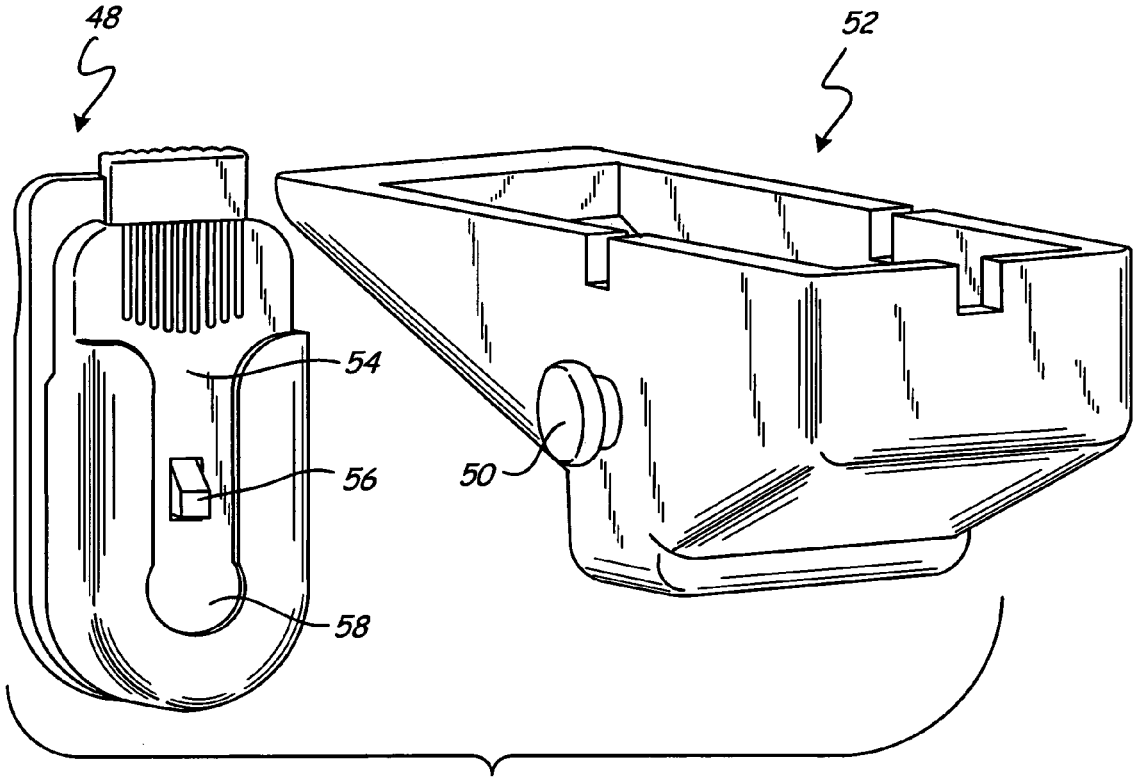
FIG. 4 is a perspective view of a clip for attachment to a button on a doorstop foot.

In an alternative embodiment, the doorstop may include a clip feature. FIG. 4 depicts an example of a clip feature where clip 48 is attachable to button 50 on doorstop foot 52. Doorstop foot 52 is structurally similar to doorstop feet 14 and 34 (in FIGS. 1-3), but has the additional feature of button 50. Clip 48 includes a recess 54 which is capable of receiving button 50. Button 50 is slid into recess 54 until it reaches protrusion 56. Button 50 slides along the angled slope of protrusion 56 and depressions protrusion 56, which in an exemplary embodiment is spring-loaded. Once button 50 depresses slides past protrusion 56 and into circular portion 58, protrusion 56 rebounds and button 50 is thereby secured in clip 48. Clip 48 may be secured to a belt or other object for easy transport of doorstop foot 52. To remove clip 48, a user depresses protrusion 56 and slides button 50 out of circular portion 58 and over protrusion 56, thereby releasing doorstop foot 52 from the clip.

A doorstop with a foot and a releasably securable handle is disclosed herein. The handle may have a fixed length or may telescope between an extended position and a collapsed position. The doorstop may include a clip feature. Optimally, a button located on the foot may be received by a recess in a clip thereby mating foot to clip. The handle may couple to the foot magnetically or mechanically. Coupling mechanisms secure the handle to the foot during doorstop use, but easily decouple for compact transport. The releasable telescoping handle and clip feature on the foot allow for easy transport of the doorstop. The doorstop described may prevent back injuries or bending down, will not damage doors, is easy to use, and decouples for easy transport.

Although the present invention has been described with reference to preferred embodiments, workers skilled in the art will recognize that changes may be made in form and detail without departing from the spirit and scope of the invention.

The invention claimed is:

1. A doorstop comprising:

a handle having an upper end, a lower end configured to telescope toward and away from the upper end, and a first magnet located at the lower end;

a substantially hollow foot having a first sloped portion extending downwardly and outwardly from a central portion, a second sloped portion extending downwardly and outwardly from the central portion in a direction opposite the first sloped portion, the second sloped portion having a slope with respect to the raised central portion that is different than the first sloped portion, the central portion being located between and raised above the first and second sloped portions, a second magnet recessed into the central portion such that a top of the second magnet is flush with a top of the central portion, the first magnet being magnetically attracted to the second magnet and thereby capable of removably coupling the handle to the foot, wherein one of the first and second sloped portions is insertable under a lower edge of a door adjacent a floor such that the substantially hollow foot is wedged beneath the lower edge of the door and deforms to stop movement of the door with respect to the floor, wherein the top of the central portion, along with the top of the second magnet, is generally flat so as to provide ease of coupling and decoupling of the first magnet to the second magnet without obstruction.

2. The doorstop of claim 1, wherein the handle is capable of telescoping between a contracted position and an extended position.

3. The doorstop of claim 1, further comprising:

a button on the foot; and a clip having a recess capable of receiving the button and being removably securable therefrom.

4. The doorstop of claim 1, wherein the handle is perpendicular to the floor when the foot is inserted under the lower edge of the door.

5. A doorstop comprising:

a telescoping handle having an upper end and a lower end, the lower end having a first magnet;

a substantially hollow foot having a first sloped portion extending downwardly and outwardly from a central portion, a second sloped portion extending downwardly and outwardly from the central portion in a direction opposite the first sloped portion, the central portion being located between and raised above the first and second sloped portions, wherein the first sloped portion has a slope with respect to the central portion that is different than a slope of the second sloped portion, the first sloped portion being insertable under a lower edge of a door adjacent a floor such that the substantially hollow foot deforms to stop movement of the door with respect to the floor, the central portion having a second magnet recessed therein such that a top surface of the second magnet is substantially coplanar with a top surface of the central portion, the second magnet being magnetically attracted to the first magnet to removably couple the handle to the foot, wherein the top of the central portion, along with the top of the second magnet, is generally flat so as to provide ease of coupling and decoupling of the first magnet to the second magnet without obstruction.

6. The doorstop of claim 5, wherein the handle is capable of telescoping between a contracted position and an extended position.

7. The doorstop of claim 6, wherein the handle is capable of telescoping from no more than 6 inches to at least 20 inches.

8. The doorstop of claim 5, further comprising:

a button on the foot; and a clip having a recess capable of receiving the button and being removably securable therefrom.

* * * * *